US007423209B2

(12) United States Patent
Chen

(10) Patent No.: US 7,423,209 B2
(45) Date of Patent: Sep. 9, 2008

(54) FIXTURE FOR A GUITAR STAND

(75) Inventor: I-Tsen Chen, Taipei (TW)

(73) Assignee: Reliance International Corp., Taipei (TW)

( * ) Notice: Subject to any disclaimer, the term of this patent is extended or adjusted under 35 U.S.C. 154(b) by 0 days.

(21) Appl. No.: 11/654,222

(22) Filed: Jan. 16, 2007

(65) Prior Publication Data

US 2008/0168883 A1 Jul. 17, 2008

(51) Int. Cl.
*G10D 3/00* (2006.01)

(52) U.S. Cl. ..... 84/327; 248/470

(58) Field of Classification Search ..... 84/327, 84/379; 248/110, 470, 95; 269/81; 211/70.6
See application file for complete search history.

(56) References Cited

U.S. PATENT DOCUMENTS 7,105,732 B1 * 9/2006 Hsieh ..... 84/327
7,259,310 B2 * 8/2007 Wilfer ..... 84/327
2006/0243686 A1 * 11/2006 Grayson ..... 211/70.6

* cited by examiner

*Primary Examiner*—Lincoln Donovan
*Assistant Examiner*—Jianchun Qin
(74) *Attorney, Agent, or Firm*—Charles E. Baxley

(57) ABSTRACT

A fixture adapted to be mounted on a stand for supporting a guitar includes a seat having two compartments, two moving blocks respectively and pivotally received in the two compartments and a resilient member received in the seat to provide recovery force to the two moving blocks after the two moving blocks are pivoted, a cap having two arcuate slots to respectively communicate with the two compartments and two arms to securely connect to a corresponding one of the two moving blocks such that when the arms are moved closer to each other to securely clamp the guitar due to limitation of the two arcuate slots and a weight of the guitar, the two moving blocks are pivoted accordingly and the recovery force from the resilient member is able to push the two moving blocks as well as the two arms back to their original positions.

6 Claims, 5 Drawing Sheets

FIXTURE FOR A GUITAR STAND

BACKGROUND OF THE INVENTION

1. Field of the Invention

The present invention relates to a fixture, and more particularly to a fixture for a guitar stand to securely position the guitar via two arms.

2. Description of the Prior Art

After performance, the guitar player normally places the guitar against a wall to have a rest. However, the guitar against the wall is easily damaged since a gentle touch to the guitar will cause the guitar to slide to the floor and breaks it. In order to prevent such disaster from happening, an improved guitar stand is introduced to the market to position the guitar after performance. The guitar stand as disclosed in U.S. Pat. No. 6,513,768 ('768 hereinafter) has two levers each having a movable hook mounted at a free end of the lever such that when a guitar is placed against the two hooks, the weight of the guitar moves the two hooks closer to each other such that the neck of the guitar is substantially clamped by the two hooks. Therefore, the guitar is securely positioned on the guitar stand.

However, it is known from the disclosure of the '768 patent that there are provided with complicated components with complex structural relationships among the components. Thus the manufacture cost is high and the number on the price tag is not easily affordable by average people.

To overcome the shortcomings, the present invention tends to provide an improved fixture for a guitar stand to mitigate the aforementioned problems.

SUMMARY OF THE INVENTION

The primary objective of the present invention is to provide an improved fixture to securely position the guitar, which is inexpensive and simple in structural relationships among components.

In order to accomplish the objective, the fixture of the present invention includes a seat having two compartments therein, a cap and two arms securely yet movable relative to the seat within the two compartments and along two arcuate slots in the cap such that the two arms securely engage with the guitar which is placed between the two arms.

In another objective of the present invention, the two arcuate slots respectively correspond to and communicate with the two compartments of the seat so that the movement of the two arms are confined by the compartments as well as by he two arcuate slots.

In yet another objective of the present invention, a resilient member is provided inside the seat to provide recovery force to the two arms such that after the guitar is removed from the fixture, the two arms are returned to their original positions by the recovery force.

Other objects, advantages and novel features of the invention will become more apparent from the following detailed description when taken in conjunction with the accompanying drawings.

DETAILED DESCRIPTION OF THE PREFERRED EMBODIMENT

Figure 1:
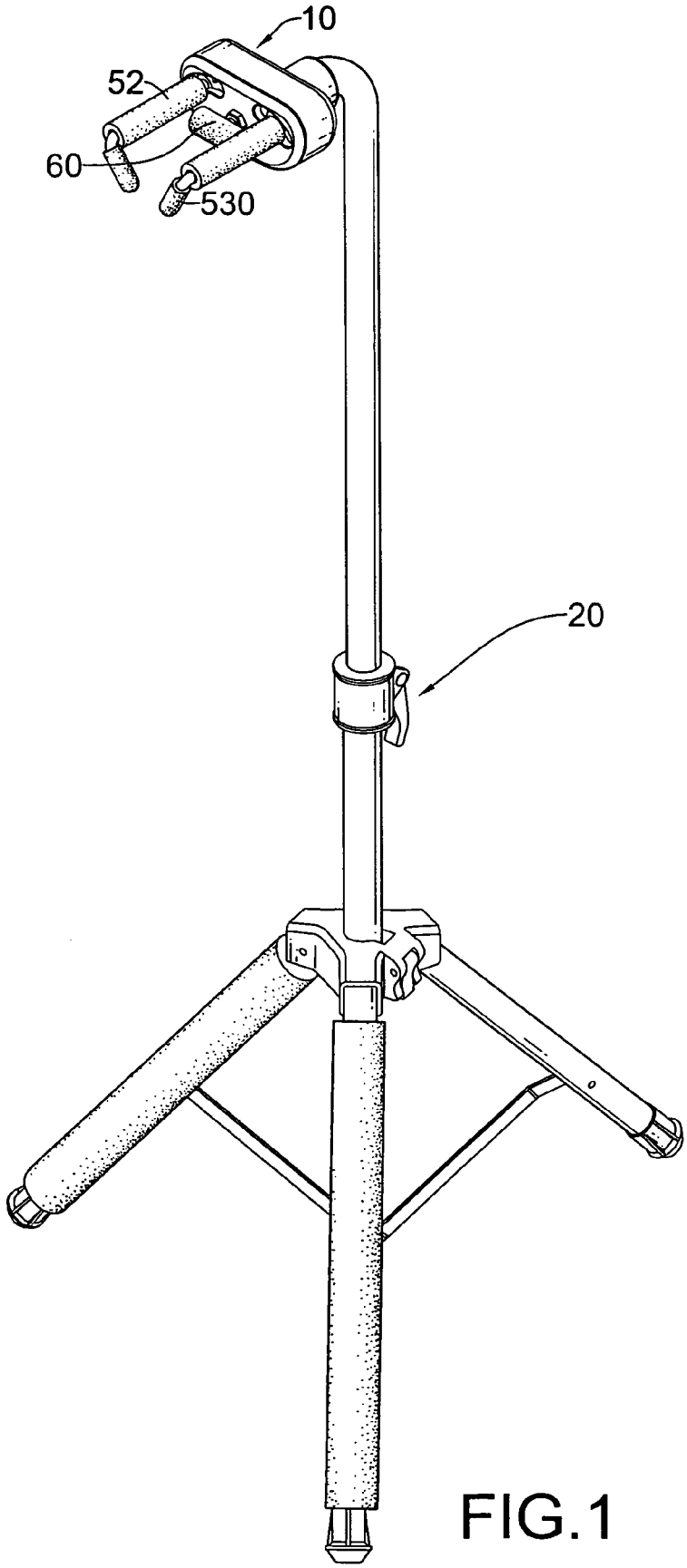
FIG. 1 is a perspective view showing that the fixture of the present invention is placed on top of a stand.
Figure 2:
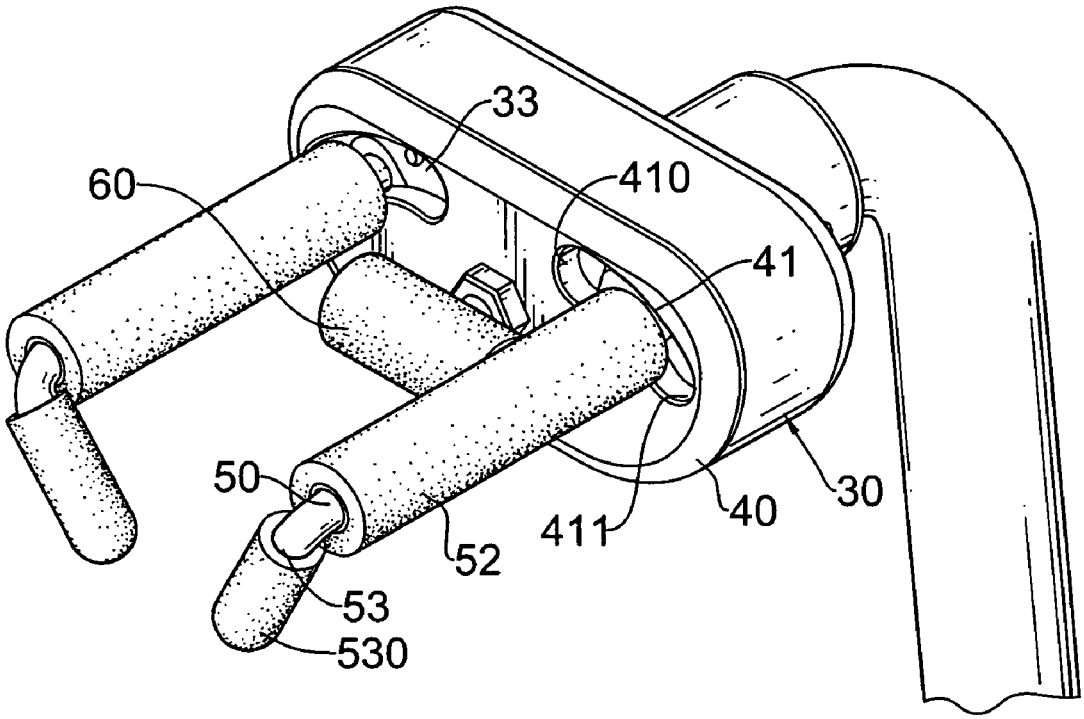
FIG. 2 is an enlarged perspective view showing the fixture of the present invention.

With reference to FIGS. 1 and 2, it is noted that the fixture (10) in accordance with the present invention is mounted on top of a stand (20) and includes a seat (30) which is firmly mounted on a free end of the stand (20), a cap (40) securely attached to a side of the seat (30), two arms (50) extending out from the seat (30) and a buffer (60) securely attached to a side of the cap (40) and between the two arms (50).

Figure 3:
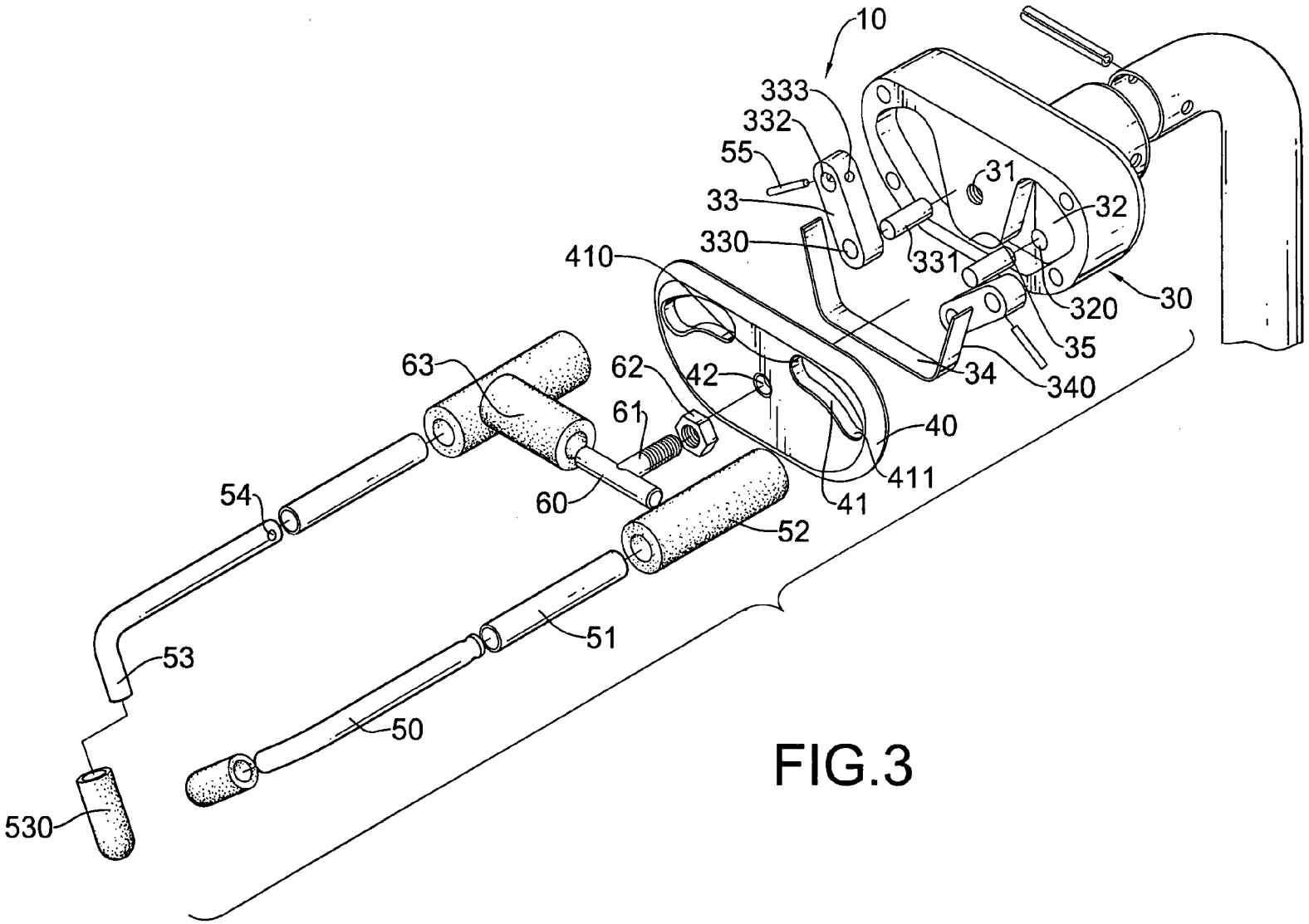
FIG. 3 is an exploded perspective view of the fixture of the present invention.

With reference t FIG. 3, it is noted that he seat (30) is provided with a centrally defined threaded hole (31), two compartments (32) separated from each other by the threaded hole (31), two moving blocks (33) respectively movable inside a corresponding one of the two compartments (32) and a resilient member (34) providing recovery force to the two moving blocks (33). A pivot hole (320) is defined in a bottom face defining the compartment (32) such that one end of a pin (331) is able to extend into the pivot hole (320). Each moving block (33) has a through hole (330) defined in a bottom end thereof to correspond to and receive therein the other end of the pin (331) such that each moving block (33) in the corresponding compartment (32) is pivotally retained and a connection hole (332) defined in a top end thereof. In addition, a side hole (333) is defined through a side of each of the moving blocks (33). A passage (35) is defined in the seat (30) to communicate the two compartments (32) with each other. In this embodiment, the passage (35) is defined at the bottom side of the seat (30). The resilient member (34) is an elongated plate with each of two free ends extending upward to become an abutting end (340).

The cap (40) is securely mounted on a side face of the seat (30) and has two arcuate slots (41) defined through the cap (40) to respectively communicate with the two compartments (32) of the seat (30) and an extension hole (42) defined through the cap (40) to correspond to and align with the threaded hole (31) of the seat (30). Each arcuate slot (41) is provided with a first position (410) and a second position (420).

Each of the two arms (50) has a tube (51), a protection tube (52) which is made of a soft material to receive therein the tube (51) and a hook (53) formed on a distal end of the tube (51) and having a protection covering (530) detachably mounted thereon. An engaging hole (54) is defined through a side of the tube (51) to correspond to and align with the side hole (333) of the moving block (33) so that an engagement pin (55) is extendable through the aligned engaging hole (54) and the side hole (333) to secure engagement between the tube (51) and the moving block (33).

The buffer (60) includes a T shaped rod, wherein a central rod of the T shaped rod is provided with a threading formed on a distal end thereof and extending through the extension hole (42) of the cap (40) after passing through a nut (62) and into the threaded hole (31) of the seat (30). An outer protection covering (63) is mounted on the T shaped rod to provide protection to the guitar.

It is noted that when the fixture of the present invention is assembled, one end of the two pins (331) is extended into a corresponding pivot hole (320) in the seat (30) and the other end of each of the two pins (331) is extended into a corresponding through hole (330) of a corresponding moving block (33) such that the two moving blocks (33) are able to pivot within the corresponding compartments (32). Then each tube (51) is extended through the protection tube (52), a corresponding arcuate slot (41) of the cap (40) and into a connection hole (332) of a corresponding moving block (33) to allow the engaging hole (54) to align with the side hole (333) of the corresponding moving block (33). The engagement pins (55) are then respectively extended into the aligned side hole (333) and the engaging hole (54) to secure engagement between the tube (51) and the moving block (33). After the engagement between the moving block (33) and the tube (51) is secured via the engagement pin (55), the pivotal movement of the two moving blocks (33) drives the two tubes (51) to move accordingly. It is further noted that because the tube (51) is extended through the arcuate slot (41), when the moving block (33) drives the tube (51) to move, the moving trajectory of the tube (51) is limited by the arcuate slot (41). That is, when the moving block (33) is pivoted and the corresponding tube (51) is driven to move accordingly, the tube (51) originally at the first position (410) is moved to the second position (411). Furthermore, the resilient member (34) is placed in the seat (30) with a body of the resilient member (34) received in the passage (35) and the two abutting ends (340) are respectively received in the two compartments (32) to abut a side face of the two moving blocks (33) so as to provide recovery force to the corresponding moving block (33).

Figure 4:
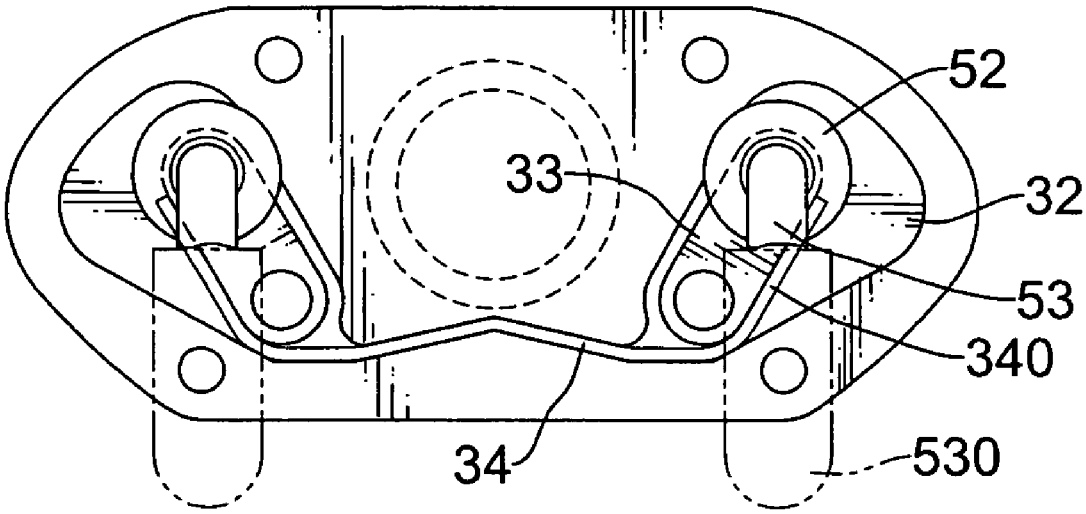
FIG. 4 is a side plan view showing the original position of the two moving blocks inside he seat.
Figure 5:
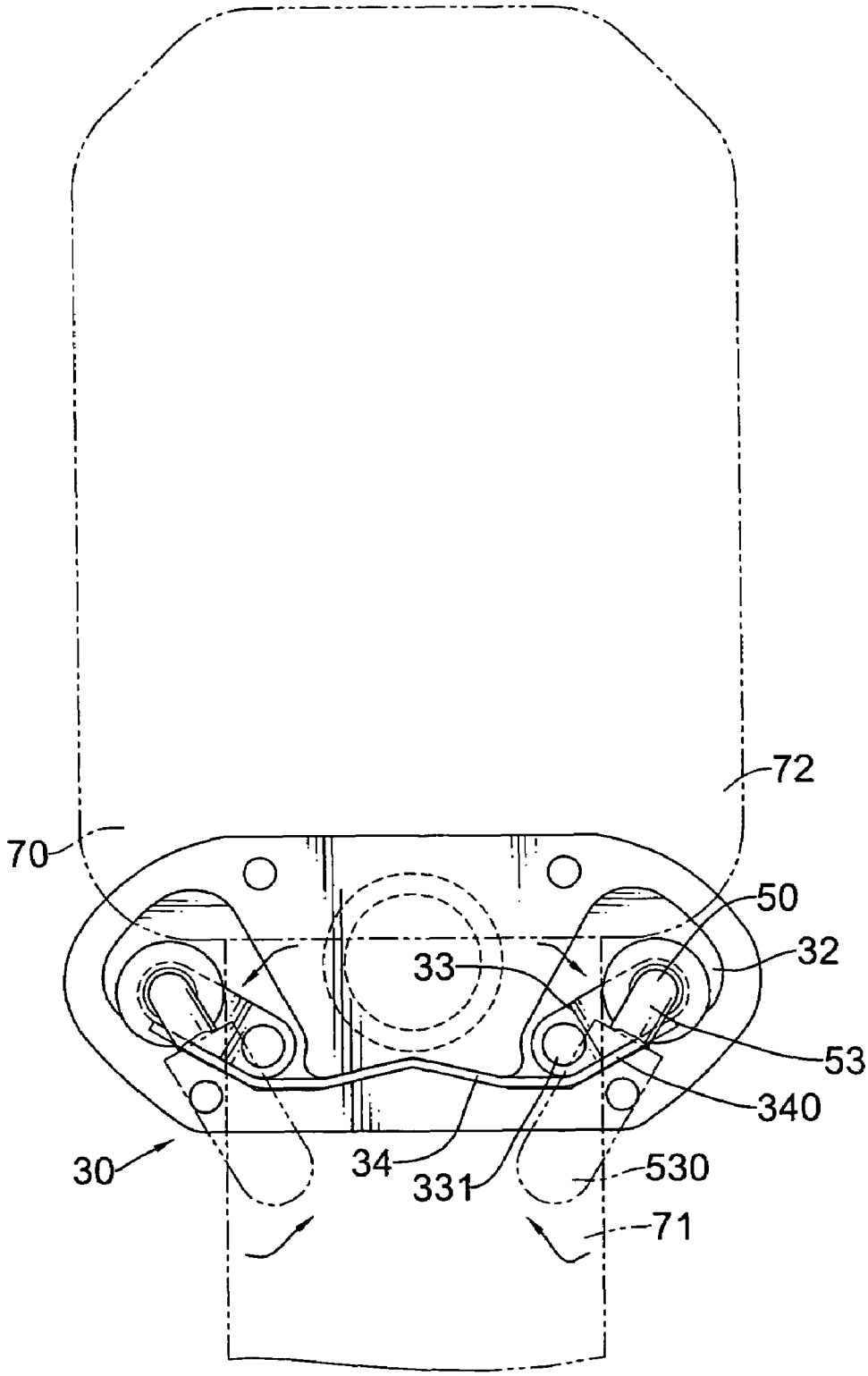
FIG. 5 is a schematic view showing that the two moving blocks are moved inside the compartments, which drives the two arms to move closer to each other.

With reference to FIGS. 4 and 5, after the fixture of the present invention is assembled and a guitar (70) is placed against the fixture with a neck (71) of the guitar (70) sandwiched between and engaged with the two arms (50), the weight of the guitar (70) on the two arms (50) drives the two arms (50) to move along the corresponding two arcuate slots (41). As stated before, movement of the two arms (50) drives the two moving blocks (33) to pivot inside the compartments (32) respectively since there is secured engagement between the corresponding moving block (33) and the arm (50). From the indication of the arrows, after the arms (50) move, the hooks (53) on the distal free end of each of the two arms (50) is moved closer to each other such that the guitar neck (71) is securely sandwiched between the two arms (50).

From the foregoing description, it is noted the structure is simple and thus the manufacture cost is low. Even though the structure is simple, the fixture of the present invention can still accomplish the designed goal, to position the guitar.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fixture adapted to be mounted on a stand for supporting a guitar, the further comprising:

a seat adapted to securely engage the stand and having two compartments defined in the seat, a pivot hole being defined in a bottom face defining each of the two compartments; and two moving blocks respectively and pivotally received in the two compartments and each of the two moving blocks has a through hole defined in a bottom end of the moving block and a first end of a pin is extended into the pivot hole and a second end of the pin is extended into the through hole to pivotally retain the moving blocks inside the compartments.

a resilient member received in the seat and having two abutting ends respectively abutted to a corresponding one of the two moving blocks so as to provide recovery force to the two moving blocks after the two moving blocks are pivoted;

a cap securely attached to a side of the seat to enclose the two moving blocks and the resilient member inside the seat the cap having two arcuate slots defined through the cap to respectively communicate with the two compartments; and two arms each extending through corresponding arcuate slot and connected securely to corresponding moving blocks such that when the arms are moved closer to each other to securely clamp the guitar between the two arcuate slots allowing the two moving blocks to pivot accordingly and the recovery force from the resilient member is able to push the two moving blocks as well as the two arms back to clamp the guitar.

2. The fixture as claimed in claim 1, wherein each arm is provided with a protection tube made of a soft material and a tube received inside the protection tube and having an engaging hole corresponding to and aligned with a side hole defined in a side of a corresponding moving block so that an engagement pin is able to extend into the aligned side hole and the engaging hole to secure engagement between one of the tubes and one of the moving blocks.

3. The fixture as claimed in claim 2 further comprising a T shaped rod mounted between the two arms and on the cap, the T shaped rod having a protection covering mounted on an outer face thereof so as to protect the guitar from damage.

4. The fixture as claimed in claim 3, wherein each moving block has a connection hole relative to the through hole to receive therein the corresponding one of the tubes.

5. The fixture as claimed in claim 2, wherein each moving block has a connection hole relative to the through hole to receive therein the corresponding one of the tubes.

6. A fixture adapted to be mounted on a stand for supporting a guitar, the fixture comprising:

a seat adapted to securely engage with the stand and having two compartments defined in the seat, two moving blocks respectively and pivotally received in the two compartments and a resilient member received in the seat and having two abutting ends respectively abutted to a corresponding one of the two moving blocks so as to provide recovery force to the two moving blocks after the two moving blocks are pivoted;

a cap securely attached to a side of the seat to enclose the two moving blocks and the resilient member inside the seat, the cap having two arcuate slots defined through the cap to respectively communicate with the two compartments;

two arms each extending through a corresponding one of the two arcuate slots to securely connect to a corresponding one of the two moving blocks such that when the arms are moved closer to each other to securely clamp the guitar due to limitation of the two arcuate slots and a weight of the guitar, the two moving blocks are pivoted accordingly and the recovery force from the resilient member is able to push the two moving blocks as well as the two arms back to their original positions; and a T shaped rod mounted between the two arms and on the cap, the T shaped rod having a protection covering mounted on an outer face thereof so as to protect the guitar from damage, wherein a pivot hole is defined in a bottom face defining each of the two compartments and a through hole is defined in a bottom end of each of the two moving blocks such that a first end of a pin is extendable into the pivot hole and a second end of the pin is extendable into the through hole to pivotally retain the moving blocks inside the compartments, each arm is provided with a protection tube made of a soft material and a tube received inside the protection tube and having an engaging hole corresponding to and aligned with a side hole defined in a side of a corresponding moving block so that an engagement pin is able to extend into the aligned side hole and the engaging hole to secure engagement between one of the tubes and one of the moving blocks, and each moving block has a connection hole relative to the through hole to receive therein the corresponding one of the tubes.

* * * * *